US006112757A

United States Patent [19]

Tseng

[11] Patent Number: 6,112,757

[45] Date of Patent: Sep. 5, 2000

[54] LEG ASSEMBLY FOR A CANOPY

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 09/296,156

[22] Filed: Apr. 21, 1999

[51] Int. Cl.[7] ..... E04H 15/50

[52] U.S. Cl. ..... 135/145; 135/131; 135/141; 135/151

[58] Field of Search ..... 135/131, 141, 135/145, 151

[56] References Cited

U.S. PATENT DOCUMENTS 5,794,640 8/1998 Jang ..... 135/131
6,035,877 3/2000 Losi ..... 135/131

*Primary Examiner*—Beth A. Stephan
*Attorney, Agent, or Firm*—Ladas & Parry

[57] ABSTRACT

A leg assembly for a canopy includes upright leg members, tubular sleeves sleeved slidably and respectively on the leg members, and connecting units extending between the leg members. Each of the connecting units includes at least two linking units and a pivot unit. Each of the linking units includes a first linking rod and a second linking rod. The first linking rod includes a lower segment, an upper segment and an intermediate segment that is formed with a slot. The slot and the upper and lower segments of the first linking rod are disposed on a common vertical plane. The lower segment has a lower end mounted pivotally on an adjacent tubular sleeve. The second linking rod has an upper end mounted pivotally on the upper end of an adjacent leg member, a lower end, and an intermediate portion extending through the slot of the first linking rod, and is pivoted to the intermediate segment about a horizontal pivot axis. The pivot unit includes an upper pivot connector connected pivotally to upper ends of the upper segments of the first linking rods, and a lower pivot connector connected pivotally to the lower ends of the second linking rods.

8 Claims, 6 Drawing Sheets

LEG ASSEMBLY FOR A CANOPY

BACKGROUND OF THE INVENTION

1. Field of the Invention

The invention relates to a leg assembly for a canopy, more particularly to a leg assembly which is relatively easy to manufacture and which occupies a relatively small amount of space when folded.

2. Description of the Related Art

FIG. 1 illustrates a conventional leg assembly 1 for supporting a canopy 10 above a ground surface. The leg assembly 1 includes four upright leg members 11, each of which has a tubular sleeve 111 sleeved slidably thereon. A connecting unit 100 is provided between a respective one of adjacent pairs of the leg members 11. Each of the connecting units 100 includes an upper pivot connector 14, a lower pivot connector 14', a pair of first linking rods 12 connected to the upper pivot connector 14 and disposed on opposite sides of the upper pivot connector 14, and a pair of second linking rods 13 connected to the lower pivot connector 14' and disposed on opposite sides of the lower pivot connector 14'. Each of the first linking rods 12 has an upper end connected pivotally to the upper pivot connector 14, and a lower end connected pivotally to the tubular sleeve 111 that is sleeved on an adjacent one of the pair of leg members 11. Each of the second linking rods 13 has an upper end connected pivotally to an upper end of an adjacent one of the pairs of leg members 11, and a lower end connected pivotally to the lower pivot connector 14' (see FIG. 2). Each of the first linking rods 12 has an intermediate portion mounted pivotally on an intermediate portion of an adjacent one of the second linking rods 13 by means of a pivot shaft 15 such that the linking rods 12, 13 are movable relative to one another between unfolded and folded states.

As shown, in each of the connecting units 100, one of the second linking rods 13 is disposed on an inner side of the adjacent first linking rod 12, while the other one of the second linking rods 13 is disposed on an outer side of the adjacent first linking rod 12. As such, the lower pivot connector 14' which interconnects the pair of second linking rods 13 must be formed with a pair of insert grooves 141 that do not extend along the same vertical plane. The same is true for the upper pivot connector 14. Thus, difficulties result during the manufacture of the leg assembly 1.

SUMMARY OF THE INVENTION

Therefore, the main object of the present invention is to provide a leg assembly which is relatively easy to manufacture so as to lower the manufacturing costs.

Accordingly, the leg assembly of the present invention is used for mounting a canopy thereon, and includes a plurality of upright leg members, a plurality of tubular sleeves sleeved slidably and respectively on the leg members, and a plurality of connecting units extending between the leg members. Each of the leg members has an upper end adapted for mounting of the canopy thereon, and a lower end adapted to be disposed on a ground surface for supporting the canopy above the ground surface. Each of the connecting units includes at least two linking units and a pivot unit interconnecting the linking units. Each of the linking units includes a first linking rod and a second linking rod. The first linking rod includes a lower segment, an upper segment and an intermediate segment interconnecting the upper and lower segments. The intermediate segment includes a parallel pair of elongated linking plates which are spaced-apart from one another and which have opposite first and second end sections. The lower segment has a lower end mounted pivotally on an adjacent one of the tubular sleeves, and an upper end connected to the first end sections of the linking plates. The upper segment has a lower end connected to the second end sections of the linking plates, and an upper end. The second linking rod has an upper end mounted pivotally on the upper end of an adjacent one of the leg members, a lower end, and an intermediate portion between the upper and lower ends. The intermediate portion of the second linking rod extends between the linking plates of the intermediate segment of the first linking rod, and is pivoted to the linking plates about a horizontal pivot axis which is disposed between the first and second end sections. The pivot unit includes an upper pivot connector which is connected pivotally to the upper ends of the upper segments of the first linking rods of the linking units, and a lower pivot connector which is connected pivotally to the lower ends of the second linking rods of the linking units. The first and second linking rods of each of the linking units are movable between an unfolded position, in which the first and second linking rods of each of the linking units cooperatively form an X-shaped formation, and a folded position, in which the tubular sleeves are slid downwardly toward the lower ends of the leg members, and in which the first and second linking rods are disposed adjacent to one another. The second linking rods and the upper and lower segments of the first linking rods of the linking units of each of the connecting units are disposed on a common vertical plane.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
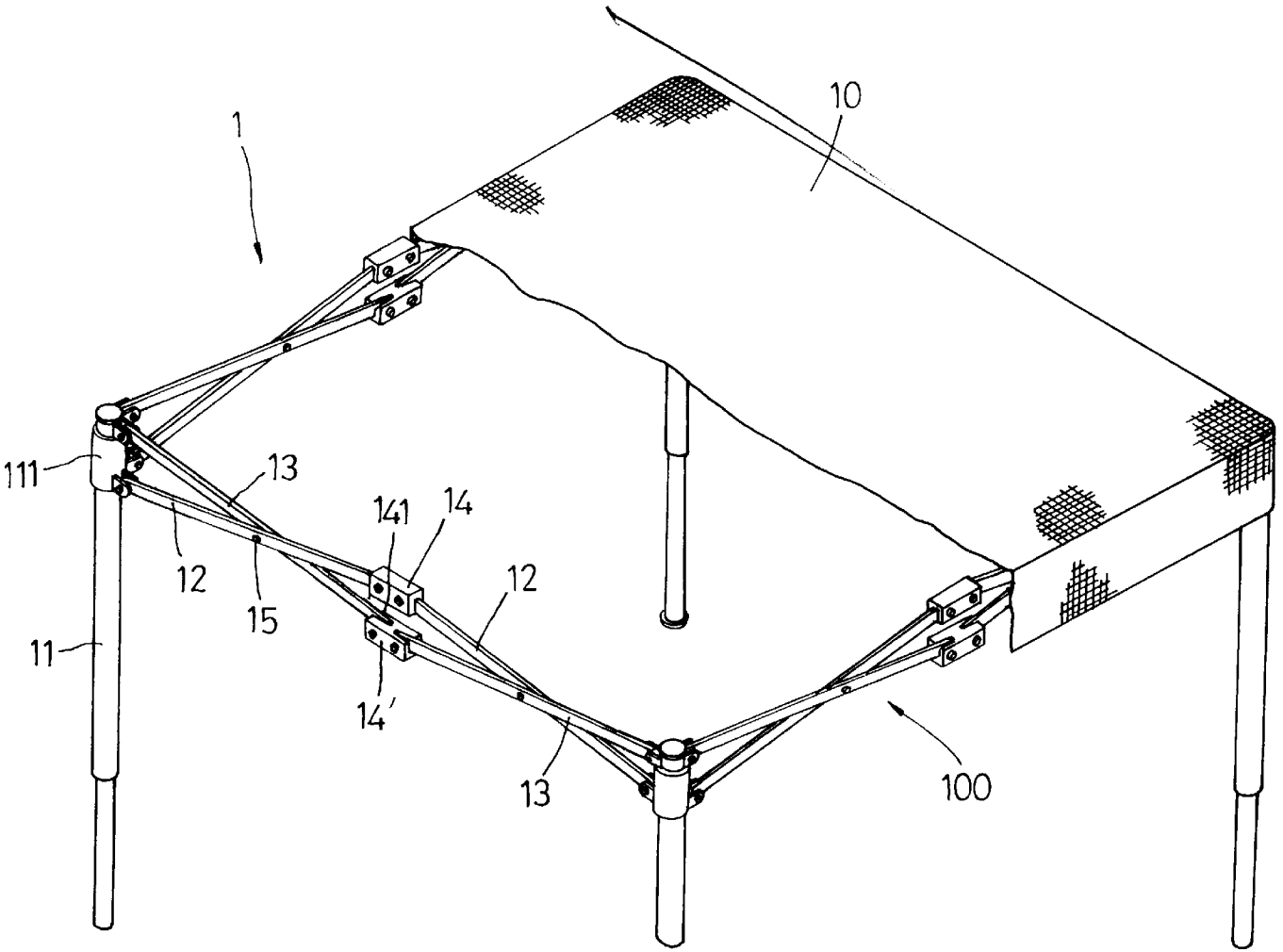
FIG. 1 PRIOR ART
FIG. 1 is a perspective view of a conventional leg assembly for supporting a canopy.
Figure 2:
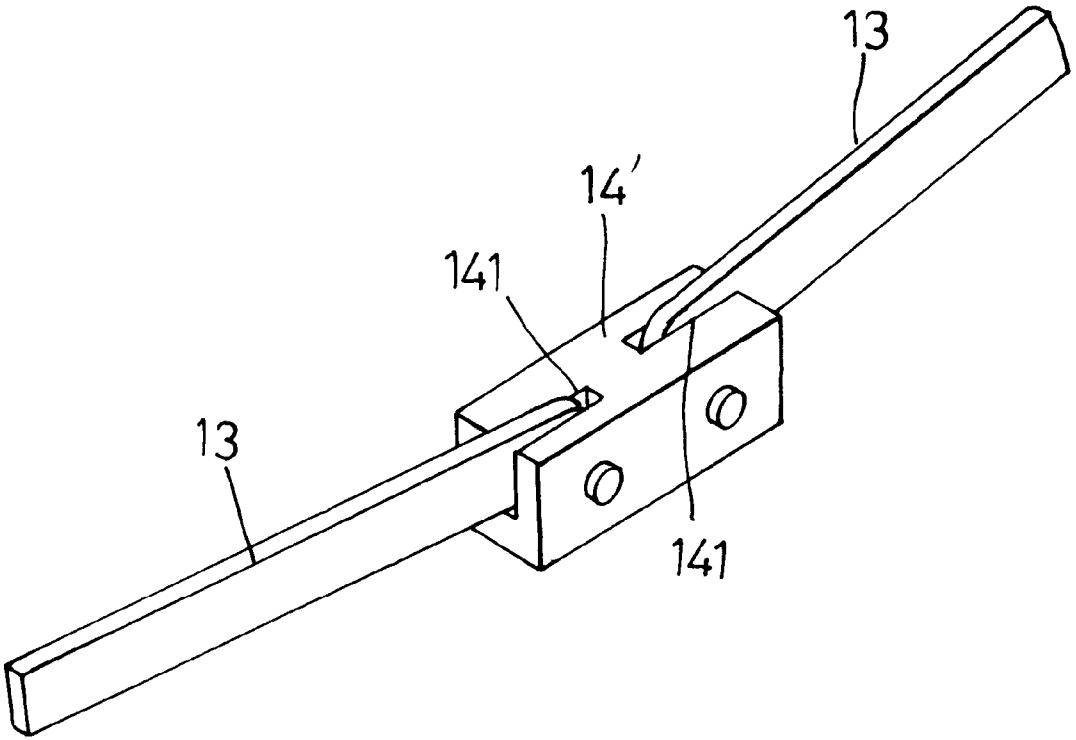
FIG. 2 PRIOR ART
FIG. 2 is a fragmentary perspective view illustrating a connecting unit of the leg assembly.
Figure 3:
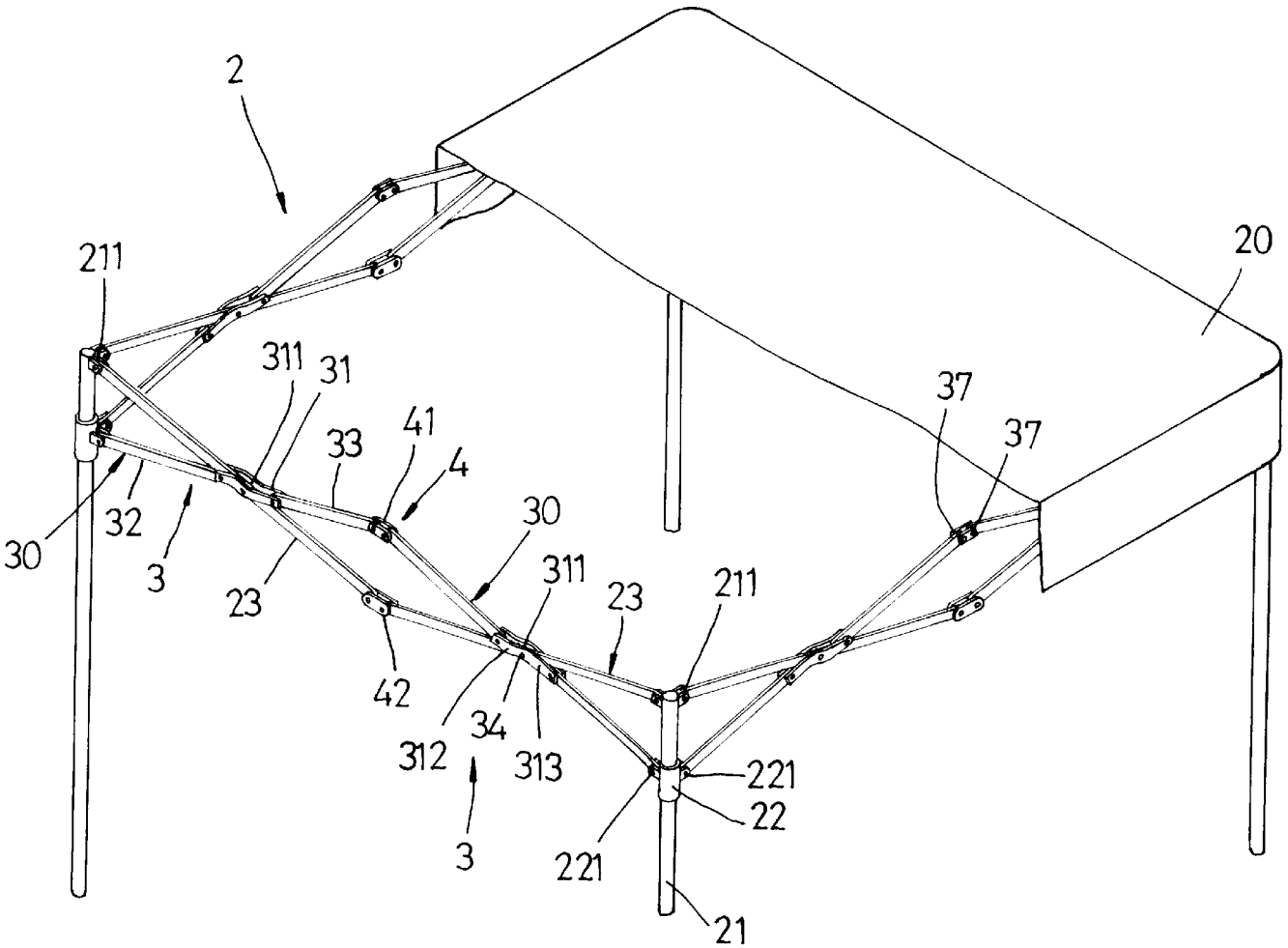
FIG. 3 is a perspective view of a preferred embodiment of a leg assembly according to the present invention.
Figure 4:
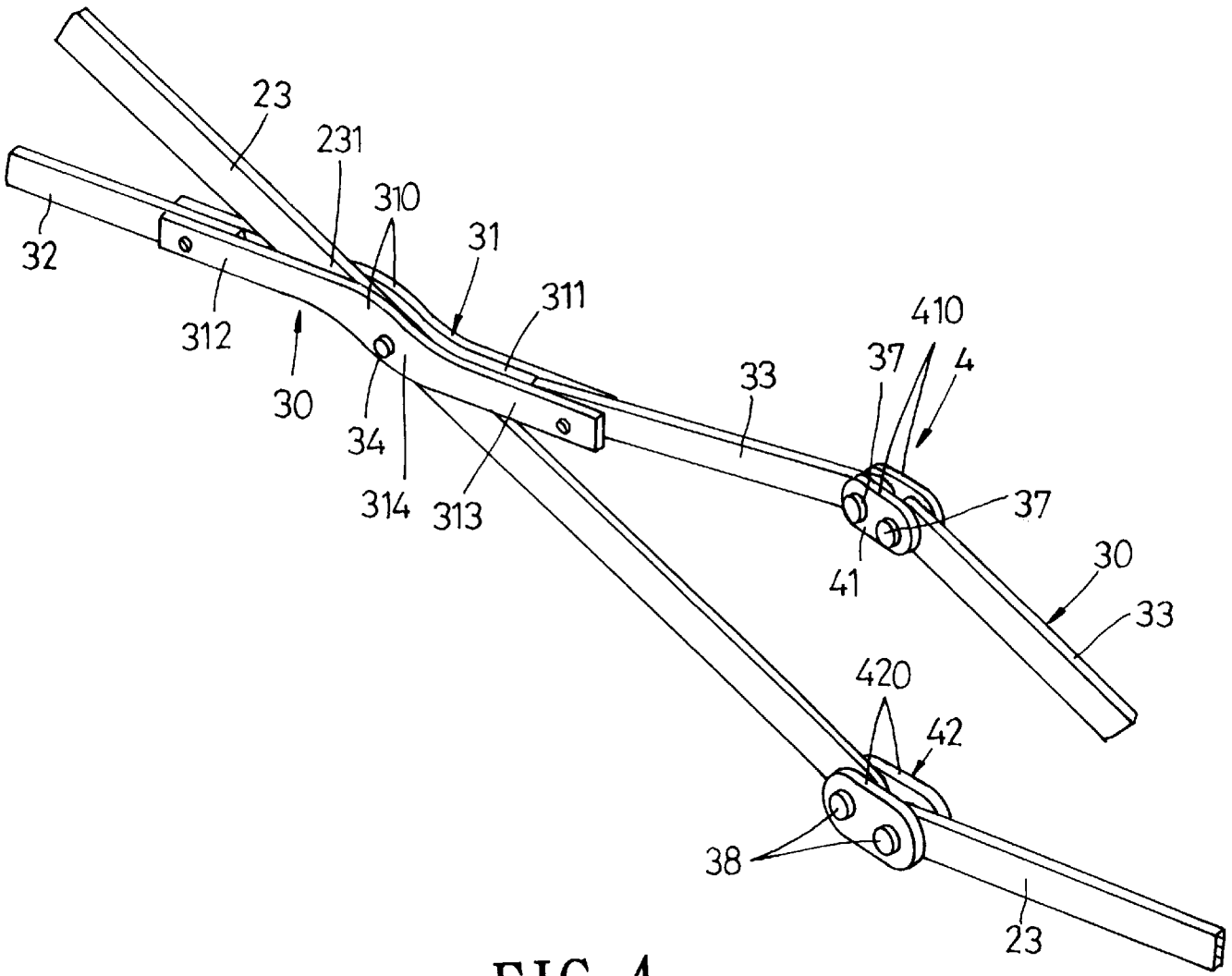
FIG. 4 is a fragmentary perspective view of a connecting unit of the preferred embodiment.

Referring to FIGS. 3 and 4, the leg assembly of the preferred embodiment of the present invention is used for mounting a canopy 20 thereon, and is shown to include four upright leg members 21, four tubular sleeves 22 which are sleeved slidably and respectively on the leg members 21, and four connecting units 2 extending between adjacent pairs of the leg members 21.

Each of the leg members 21 has an upper end which is adapted for mounting of the canopy 20 thereon and which is formed with a pair of upper pivot lobes 211, and a lower end adapted to be disposed on a ground surface for supporting the canopy 20 above the ground surface.

Each of the tubular sleeves 22 is formed with a pair of lower pivot lobes 221 which are disposed respectively below the upper pivot lobes 211 on the upper end of a corresponding one of the leg members 21.

Each of the connecting units 2 interconnects a respective one of adjacent pairs of the leg members 21, and includes two linking units 3 and a pivot unit 4, which includes an upper pivot connector 41 and a lower pivot connector 42, for interconnecting the linking units 3.

Each of the linking units 3 includes a first linking rod 30 and a second linking rod 23. The first linking rod 30 includes a lower segment 32, an upper segment 33, and an intermediate segment 31 disposed between the lower and upper segments 32, 33. The intermediate segment 31 has first and second end sections 312, 313 connected securely and respectively to the lower and upper segments 32, 33, and a central portion 314 which is formed between the first and second end sections 312, 313 and which is disposed on a longitudinal axis of the intermediate segment 31. The first and second end sections 312, 313 are parallel to each other, and extend in opposite directions from the central portion 314 on opposite sides of the longitudinal axis. The lower segment 32 has a lower end mounted pivotally on the lower pivot lobes 221 of the tubular sleeve 22 that is sleeved on an adjacent one of the leg members 21, and an upper end fastened securely to the first end section 312 of the intermediate segment 31. The upper segment 33 has a lower end fastened securely to the second end section 313 of the intermediate segment 31, and an upper end mounted pivotally on the upper pivot connector 41 of the pivot unit 4 by means of a pivot pin 37. As shown, the intermediate segment 31 is formed from a parallel pair of linking plates 310 which are spaced-apart from one another to define an elongated slot 311 therebetween. Each of the lower and upper segments 32, 33 is formed as a flat strip. The upper end of the lower segment 32 and the lower end of the upper segment 33 extend between the linking plates 310 such that the lower segment 32, the upper segment 33 and the slot 311 are all disposed on a common vertical plane. The intermediate segment 31 thus has a thickness greater than that of the lower and upper segments 32, 33.

The second linking rod 23 of each of the linking units 3 has an upper end mounted pivotally on the upper pivot lobes 211 on the upper end of an adjacent one of the leg members 21, a lower end mounted pivotally on the lower pivot connector 42 of the pivot unit 4 by means of a pivot pin 38, and an intermediate portion 231 between the upper and lower ends. The intermediate portion 231 of the second linking rod 23 extends through the slot 311 in the intermediate segment 31 of the first linking rod 30, and is connected pivotally to the linking plates 310 by means of a horizontal pivot shaft 34 transverse to the longitudinal axis of the intermediate segment 31 such that the first and second linking rods 30, 23 are movable pivotally relative to each other about the pivot shaft 34.

Since the second linking rod 23 and the lower and upper segments 32, 33 of the first linking rod 30 are disposed on a common vertical plane, each of the upper and lower pivot connectors 41, 42 of the pivot unit 4 can be made to have a relatively simple structure that includes a parallel pair of pivot plates 410, 420. The pivot pins 37, 38 extend through the pivot plates 410, 420, respectively.

Figure 5:
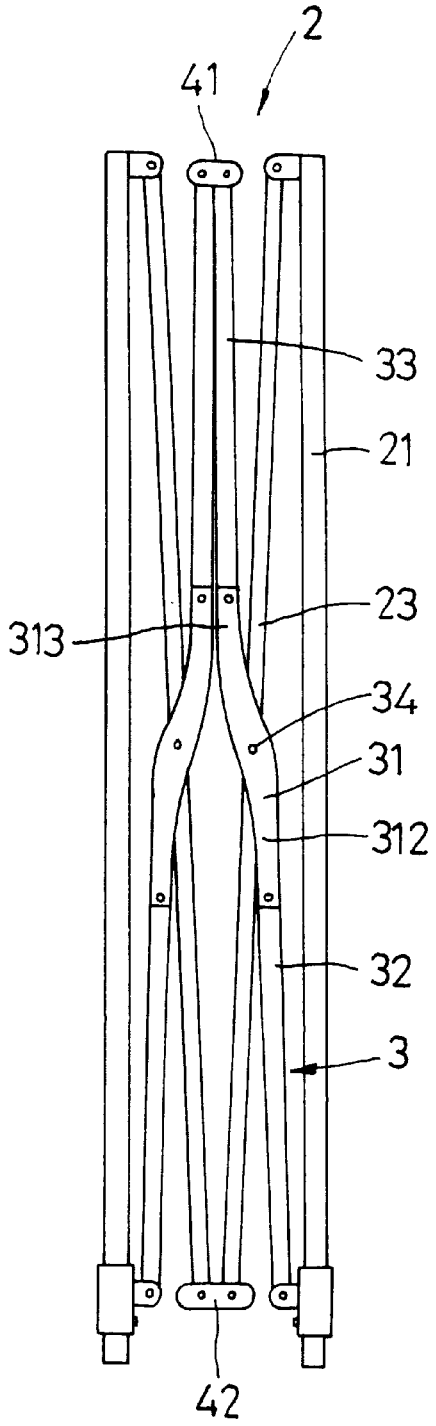
FIG. 5 is a schematic side view illustrating the leg assembly of the preferred embodiment when folded.

As shown in FIG. 3, when the leg assembly is unfolded, the first and second linking rods 30, 23 of each of the linking units 3 cooperatively form an X-shaped formation. To fold the leg assembly, as shown in FIG. 5, the leg members 21 are moved closer to one another. At this time, the tubular sleeves 22 are slid downwardly along the respective leg member 21, and the first and second linking rods 30, 23 of each of the linking units 3 are moved pivotally relative to each other about the pivot shaft 34 so as to be disposed adjacent to one another. Since the first and second end sections 312, 313 of the intermediate segment 31 of the first linking rod 30 do not extend along the longitudinal axis of the first linking rod 30, and are disposed on opposite sides of the longitudinal axis, the second linking rod 23 and the lower and upper segments 32, 33 of the first linking rod 30 can be disposed almost vertically upon folding. Therefore, the second linking rod 23 can be disposed relatively close to the lower and upper segments 32, 33 of the first linking rod 30. The connecting unit 2 thus has a relatively small width when the leg assembly is folded to result in a reduced size for the leg assembly.

Figure 6:
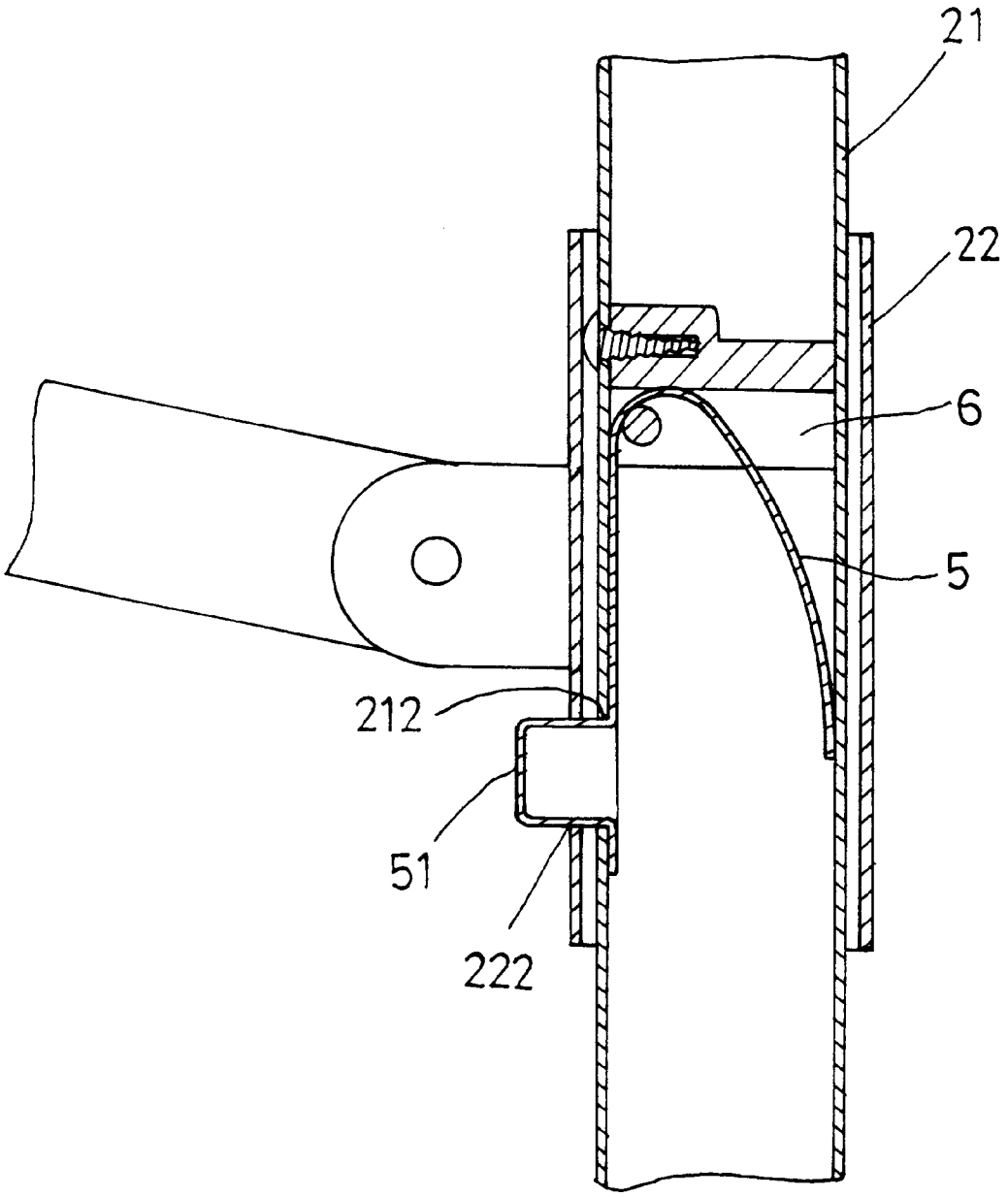
FIG. 6 is a fragmentary partly sectional schematic side view illustrating the connection between a leg member and a tubular sleeve of the preferred embodiment.

Referring to FIG. 6, each of leg members 21 is hollow, and is formed with upper and lower radial holes 212 (only one radial hole is shown). Two mounting blocks 6 (only one mounting block is shown) are provided within a respective one of the leg members 21 adjacent to the radial holes 212, respectively, and are fastened to the respective leg member 21. A curved spring plate 5 is mounted on the mounting block 6, and has a retaining projection 51 which projects from the adjacent radial hole 212. Each of the tubular sleeves 22 is formed with a radial retaining hole 222 for engaging releasably the retaining projection 51 of the spring plate 5. When the tubular sleeves 22 slide downwardly or upwardly along the leg members 21 during folding or unfolding of the leg assembly, the retaining projections 51 are retractable inwardly of the leg members 21 so as not to block the sliding movement of the tubular sleeves 22. When the tubular sleeves 22 keep on moving along the leg members 21 to align the retaining holes 222 with the retaining projections 51, respectively, the retaining projections 51 are extendible outwardly to project through the retaining holes 222 in the tubular sleeves 22 so as to engage releasably the tubular sleeves 22, thereby retaining the tubular sleeves 22 at the folded or unfolded position.

It has thus been shown that the leg assembly of the present invention occupies a relatively small amount of space after folding. Moreover, the pivot units 4 of the leg assembly of the present invention can be made to have relatively simple structures, thereby significantly reducing the manufacturing costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A leg assembly for a canopy, said leg assembly comprising:

a plurality of upright leg members, each of which has an upper end adapted for mounting of the canopy thereon, and a lower end adapted to be disposed on a ground surface for supporting the canopy above the ground surface;

plurality of tubular sleeves sleeved slidably and respectively on said leg members; and a plurality of connecting units extending between adjacent pairs of said leg members, each of said connecting units including at least two linking units and a pivot unit interconnecting said linking units;

each of said linking units including:

a first linking rod that includes a lower segment, an upper segment and an intermediate segment interconnecting said upper and lower segments, said intermediate segment including a parallel pair of elongated linking plates which are spaced-apart from one another and which have opposite first and second end sections, said lower segment having a lower end mounted pivotally on an adjacent one of said tubular sleeves, and an upper end connected to said first end sections of said linking plates, said upper segment having a lower end connected to said second end sections of said linking plates, and an upper end; and a second linking rod having an upper end mounted pivotally on said upper end of an adjacent one of said leg members, a lower end, and an intermediate portion between said upper and lower ends, said intermediate portion of said second linking rod extending between said linking plates of said intermediate segment of said first linking rod and being pivoted to said linking plates about a horizontal pivot axis which is disposed between said first and second end sections;

said pivot unit including an upper pivot connector which is connected pivotally to said upper ends of said upper segments of said first linking rods of said linking units, and a lower pivot connector which is connected pivotally to said lower ends of said second linking rods of said linking units;

said first and second linking rods of each of said linking units being movable between an unfolded position, in which said first and second linking rods of each of said linking units cooperatively form an X-shaped formation, and a folded position, in which said tubular sleeves are slid downwardly toward said lower ends of said leg members and in which said first and second linking rods are disposed adjacent to one another;

said second linking rods and said upper and lower segments of said first linking rods of said linking units of each of said connecting units being disposed on a common vertical plane.

2. The leg assembly according to claim 1, wherein each of said upper and lower pivot connectors of said pivot unit includes a parallel pair of spaced-apart pivot plates, said upper ends of said upper segments of said first linking rods extending between said pivot plates of said upper pivot connector and being mounted pivotally on said pivot plates of said upper pivot connector, said lower ends of said second linking rods extending between said pivot plates of said lower pivot connector and being mounted pivotally on said pivot plates of said lower pivot connector.

3. The leg assembly according to claim 1, wherein each of said linking plates of each of said first linking rods has a longitudinal axis and a central portion disposed on said longitudinal axis and between said first and second end sections, said pivot axis extending through said central portion transverse to said longitudinal axis, said first and second end sections being parallel to each other and extending in opposite directions from said central portion on opposite sides of said longitudinal axis.

4. The leg assembly according to claim 1, wherein each of said leg members is provided with retaining means for retaining a respective one of said tubular sleeves at the unfolded position.

5. The leg assembly according to claim 4, wherein said retaining means includes a retractable retaining projection which projects radially from said leg member, each of said tubular sleeves being formed with a radial retaining hole, said retaining projection engaging releasably said retaining hole for retaining said tubular sleeve at the unfolded position.

6. The leg assembly according to claim 5, wherein each of said leg members is hollow and is formed with a radial hole, each of said leg members being provided with a spring member therein, said retaining projection being provided on said spring member and projecting through said radial hole.

7. The leg assembly according to claim 1, wherein said second linking rod of each of said linking units is of an one-piece construction.

8. A leg assembly for a canopy, said leg assembly comprising:

a plurality of upright leg members, each of which has an upper end adapted for mounting of the canopy thereon, and a lower end adapted to be disposed on a ground surface for supporting the canopy above the ground surface;

a plurality of tubular sleeves sleeved slidably and respectively on said leg members; and a plurality of connecting units extending between adjacent pairs of said leg members, each of said connecting units including at least two linking units and a pivot unit interconnecting said linking units;

each of said linking units including:

a first linking rod that includes a lower segment, an upper segment and an intermediate segment between said upper and lower segments, said intermediate segment having a thickness larger than a thickness of each of said upper and lower segments, said intermediate segment being formed with an elongated slot, said lower segment having a lower end mounted pivotally on an adjacent one of said tubular sleeves, said upper segment having an upper end, said elongated slot and said upper and lower segments being disposed on a common vertical plane; and a second linking rod having an upper end mounted pivotally on said upper end of an adjacent one of said leg members, a lower end, and an intermediate portion between said upper and lower ends, said intermediate portion of said second linking rod extending through said slot in said first linking rod and being pivoted to said intermediate segment of said first linking rod about a horizontal pivot axis;

said pivot unit including an upper pivot connector which is connected pivotally to said upper ends of said upper segments of said first linking rods of said linking units, and a lower pivot connector which is connected pivotally to said lower ends of said second linking rods of said linking units;

said first and second linking rods of each of said linking units being movable between an unfolded position, in which said first and second linking rods of each of said linking units cooperatively form an X-shaped formation, and a folded position, in which said tubular sleeves are slid downwardly toward said lower ends of said leg members and in which said first and second linking rods are disposed adjacent to one another.

* * * * *